US011445841B2

(12) United States Patent
Prieto et al.

(10) Patent No.: US 11,445,841 B2
(45) Date of Patent: Sep. 20, 2022

(54) ADSORPTIVE ANTI-TIPPING DEVICE AND A CUP BODY MATCHED THEREWITH

(71) Applicant: GENICOOK PRODUCT, LLC, Garland, TX (US)

(72) Inventors: David de Sicart Prieto, Barcelona (ES); Marc Salvador Zamora, Barcelona (ES); Jianzhong Zhang, Shijiazhuang (CN); Xiaojia Liu, Shijiazhuang (CN)

(73) Assignee: GENICOOK PRODUCT, LLC, Garland, TX (US)

( * ) Notice: Subject to any disclaimer, the term of this patent is extended or adjusted under 35 U.S.C. 154(b) by 27 days.

(21) Appl. No.: 17/115,856

(22) Filed: Dec. 9, 2020

(65) Prior Publication Data

US 2022/0079363 A1 Mar. 17, 2022

(30) Foreign Application Priority Data

Sep. 11, 2020 (CN) ..... 202021985449.5

(51) Int. Cl.
*A47G 23/02* (2006.01)

(52) U.S. Cl.
CPC ..... *A47G 23/0216* (2013.01); *A47G 2400/08* (2013.01)

(58) Field of Classification Search
CPC ..... A47G 23/0216; A47G 2400/08; A47G 29/087; A47G 19/10; A47G 19/2205; A47G 2023/0283; A47G 23/0225; F16B 2/185; F16B 7/10; F16B 47/006; F16B 13/0808; F16B 9/02; F16M 11/2014; F16M 2200/06; F16M 2200/024; B60R 9/058; B60R 9/12; Y10T 403/599; Y10T 403/595; B65D 45/327
USPC ... 248/206.2, 206.1, 309.3, 362, 537, 206.3; 269/21; 40/597; 403/90; 220/628, 630, 220/632, 636, 737, 738–739, 483
See application file for complete search history.

(56) References Cited

U.S. PATENT DOCUMENTS

2014/0117031 A1* 5/2014 Zimmerman ..... A47G 29/093 220/737
2018/0208389 A1* 7/2018 Dowd ..... A47G 19/2261
2020/0237078 A1* 7/2020 Walton ..... G02B 7/182

FOREIGN PATENT DOCUMENTS

CN 108669982 A * 10/2018 ..... A47G 23/0225
GB 2540797 A * 2/2017 ..... A47G 23/02
JP 6675108 B1 * 4/2020 ..... F16B 47/00

* cited by examiner

*Primary Examiner* — John K Fristoe, Jr.
*Assistant Examiner* — John Martin Hoppmann
(74) *Attorney, Agent, or Firm* — IPro, PLLC; Na Xu

(57) ABSTRACT

An adsorptive anti-tipping device and a cup body matched therewith, being used to fasten the cup body to prevent it from tipping, including a driving rod, which driving rod comprises a sliding rod, a limit rod and an abutment rod, the limit rod is vertically fixed on the upper end of the sliding rod; the abutment rod is fixedly connected with one end of the sliding rod; on a fixed cover is arranged a sliding positioning hole, and the limit rod is limited above the fixed cover; the suction component is slidably clamped with the fixed cover, and has a driving slope and a driving block on it, the driving block corresponds to the position of the adsorptive surface of the suction component,. The present application is simple in structure and easy to use. Using a suction cup to adsorb the surface, the present application may prevent containers' tipping.

9 Claims, 8 Drawing Sheets

ADSORPTIVE ANTI-TIPPING DEVICE AND A CUP BODY MATCHED THEREWITH

CROSS REFERENCE TO RELATED APPLICATIONS

The present application claims the benefit of Chinese patent application No. 202021985449.5 filed on Sep. 11, 2020, which is hereby incorporated by reference herein in its entirety.

TECHNICAL FIELD

The present application relates to an auxiliary tool for daily use. Specifically, it relates to an adsorptive anti-tipping device and a cup body matched therewith.

BACKGROUND OF THE INVENTION

Beverage containers in the prior art, such as glasses, mugs, cans, bottles and the like, are prone to tipping and consequent content spillage due to the fact that their center of gravity is higher than the supporting bottom, resulting in unnecessary waste and troublesome cleaning problem. When these containers are subjected to side loads, the center of gravity will rise, thus rendering them no longer stable. These side loads may be imparted by inadvertently knocking the container with a hand or arm or when the container is subject to acceleration forces (horizontal, vertical or in any other direction) within the confines of a moving land vehicle, aircraft or watercraft. Glasses and mugs, due to their relatively large openings, are particularly prone to major content loss in the event of tipping. Although this problem can be addressed by adding a removable cover thereon to avoid the spillage of contents, the cover is easily over tightened or unscrewed, which may lead to inconvenient use.

It is known that a suction device can be used to secure a container having opening to a surface to avoid tipping. Such devices, however, require the user not only to affirmatively place the container into contact with the suction device, but also to apply a downward force to secure the suction device to the surface, or to perform an unlocking action to release the suction device from the surface or to release the container from the suction device. Hence it is inconvenient to use.

Therefore, it is urgent for those skilled in the art to provide an adsorptive anti-tipping device to prevent tipping of the cup body and the consequent spillage of the contents.

SUMMARY OF THE INVENTION

In view of the above, the present application provides a device which can prevent the container from tipping, which is simple and practical, and easy to be promoted.

To achieve the above purpose, the present application adopts the following technical solution:

An adsorptive anti-tipping device, being used to fasten a cup body and prevent the cup body from tipping, and comprising a driving rod, including a sliding rod, a limit rod and an abutment rod, wherein the limit rod is vertically fixed on the upper end of the sliding rod; and the abutment rod is fixedly connected with one end of the sliding rod;

a fixed cover, wherein on the fixed cover is arranged a sliding positioning hole, the limit rod is limited above the fixed cover; the abutment rod and sliding rod pass through the sliding positioning hole in turn, and the sliding rod is vertically slidably positioned in the sliding positioning hole, and the upper end face of the fixed cover can be disassembled and reassembled with the bottom end face of the cup body;

a suction component, wherein the suction component is slidably clamped with the fixed cover, and has a driving slope and a driving block on it, the driving block corresponds to the position of the adsorptive surface of the suction component, the abutment rod abuts with the driving block; and one side of the abutment rod abuts against the driving slope, the sliding rod drives the abutment rod when sliding upward, and drives the driving block to move under the action of the driving slope.

The present application has the following beneficial effects. The device of the present application sets a sucker for adsorbing on the nonporous plane. When a cup body or a container is placed on the device, as the cup body or container is buckled on the device, the sucker is adsorbed on the surface due to the action of buckle force, thereby the container is not prone to tip when being touched from the side; when the cup body or container is picked up, the buckle force between the cup body and the fixed cover drives the fixed cover to move the limit rod above the fixed cover upward, and the abutment rod moves laterally under the action of the driving slope, and then prods the driving block to drive the bottom end face of the suction component at the corresponding position to move slightly, thus air leaks out from the gap between the bottom end face of the suction component and its contact surface, and the sucker is loosened. With this invention, it is realized that a container is in a state of adsorptive anti-tipping or loosened when the cup body is naturally picked up or put down. It is simple and practical, with good prospects for promotion.

Preferably, the suction component comprises, arranged from top to bottom, a suction cup fixing seat, a suction cup and a suction cup base. The driving block is fixed at a position on the upper end face of the suction cup, close to the outer end of its circumference; the driving slope is arranged on the inner surface of the suction cup fixing seat; the suction cup fixing seat, the suction cup and the suction cup base are fixed coaxially in the middle; the peripheral side of the suction cup fixing seat is slidably clamped with the inner wall of the fixed cover.

Preferably, the side wall of the suction cup fixing seat is annular, and outside the annular side wall are arranged along its axial direction sliding grooves in which at least the upper end of each grooves is unobstructed; the inner wall of the fixed cover has corresponding sliding blocks, which sliding blocks are slidably connected in the sliding grooves.

Preferably, the suction cup fixing seat, the suction cup and the suction cup base are fixed by bolts passing through successively.

Preferably, the abutment rod is L-type and horizontally arranged, and the driving block is provided with a step surface on the side facing the abutment rod, the abutment rod abuts with the step surface and the corresponding step side wall surface; the lower end of the sliding rod is vertically fixed with one end of the abutment rod; on the fixed cover is provided with an L-type through-hole for the abutment rod to pass through.

Preferably, on the fixed cover is arranged a limit groove, the limit rod is fitly abutted in the limit groove.

Preferably, facing the inner circumference of the side wall of the suction cup fixing seat are arranged a plurality of clamping blocks. The clamping blocks are connected with a spring tightening rope, one end of the spring tightening rope is passing through the fixed cover, going around the top of the fixed cover, and then connecting the adjacent clamping blocks successively, thus the fixed cover and the suction cup fixing seat are closely fitted, facilitating the cup body's reset after it drives the fixed cover to move upward.

Preferably, on the fixed cover are arranged strip-shaped grooves, being located on the line that the spring tightening rope above the fixed cover is fitly connected with the clamping blocks.

Preferably, on the fixed cover are also arranged installation grooves, and at the bottom end of the cup body are integrally arranged a plurality of barbs for fitting the installation grooves, the barbs are clamped in the installation grooves.

1 sliding rod, 2 abutment rod, 3 fixed cover, 4 sliding positioning hole, 5 driving slope, 6 driving block, 7 limit rod, 8 sliding groove, 9 limit groove, 10 suction cup, 11 suction cup base, 12 suction cup fixing seat, 13 clamping block, 14 spring tightening rope, 15 strip-shaped groove, 16 installation groove, 100 cup body, 101 barb.

DETAILED DESCRIPTION OF EXEMPLARY EMBODIMENTS

Hereinbelow the technical solutions in the embodiments of the present application will be described clearly and comprehensively in combination with the drawings in the embodiments of the present application. Obviously, the described embodiments are only part of the embodiments of the present application, not all of the embodiments. Based on the embodiments of the present application, all other embodiments obtained by person skilled in the art without creative effort fall within the scope of protection of the present application.

Figure 3:
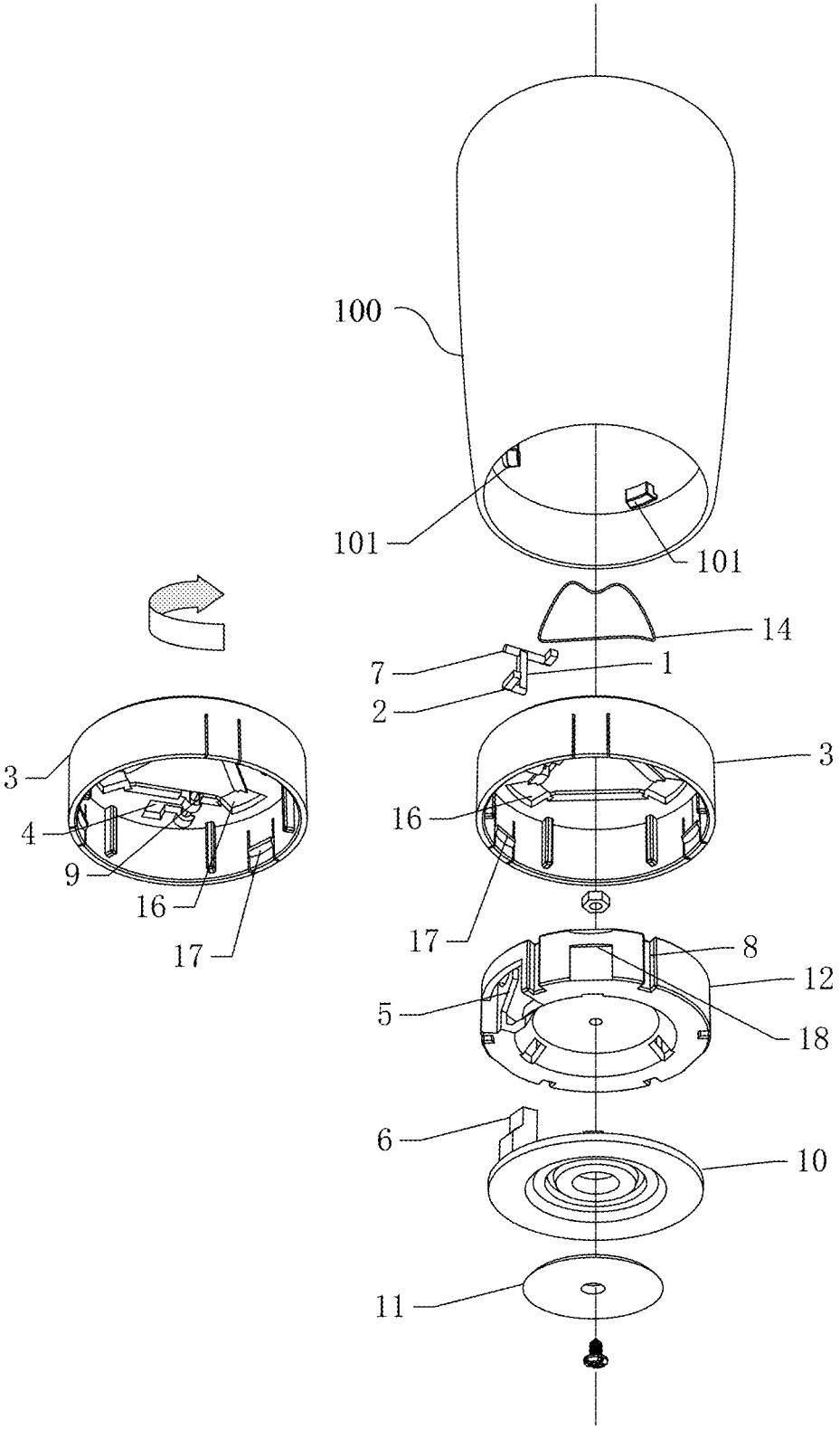
FIG. 3 is an exploded bottom perspective view of a cup comprising the adsorptive anti-tipping device of FIG. 1.
Figure 4A:
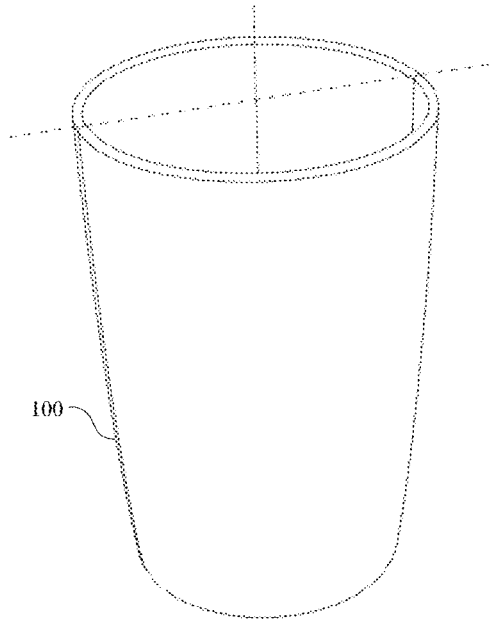
FIG. 4A is a perspective view of the cup of FIG. 3.
Figure 4B:
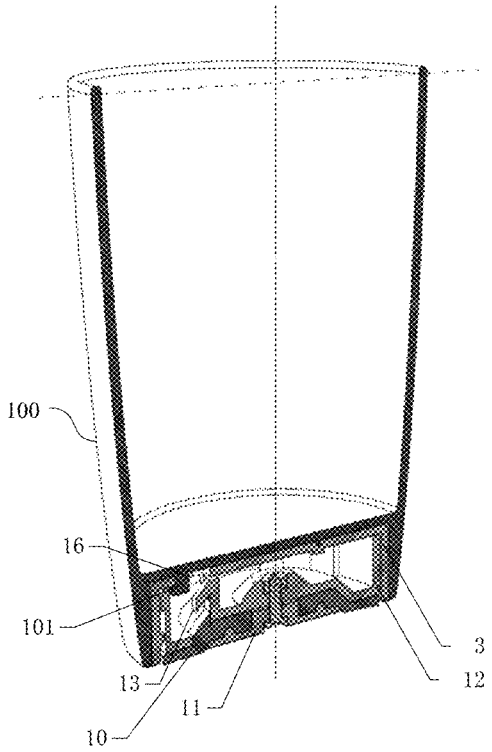
FIG. 4B is a perspective, cross-sectional view of the cup of FIG. 4A.
Figure 4C:
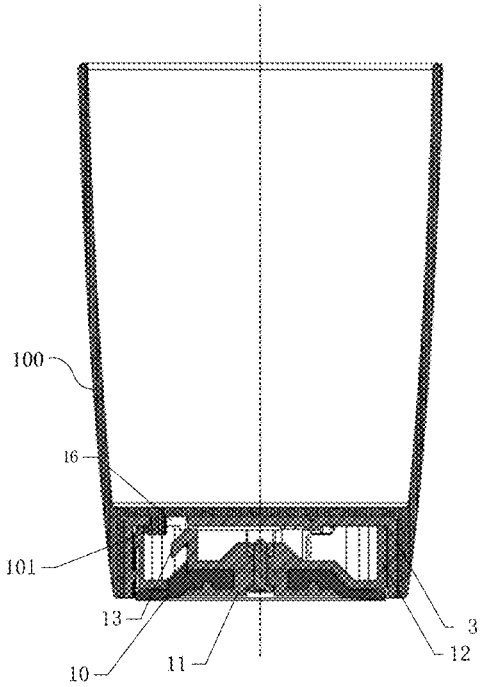
FIG. 4C is a cross-sectional view of the cup of FIG. 4A.
Figure 5:
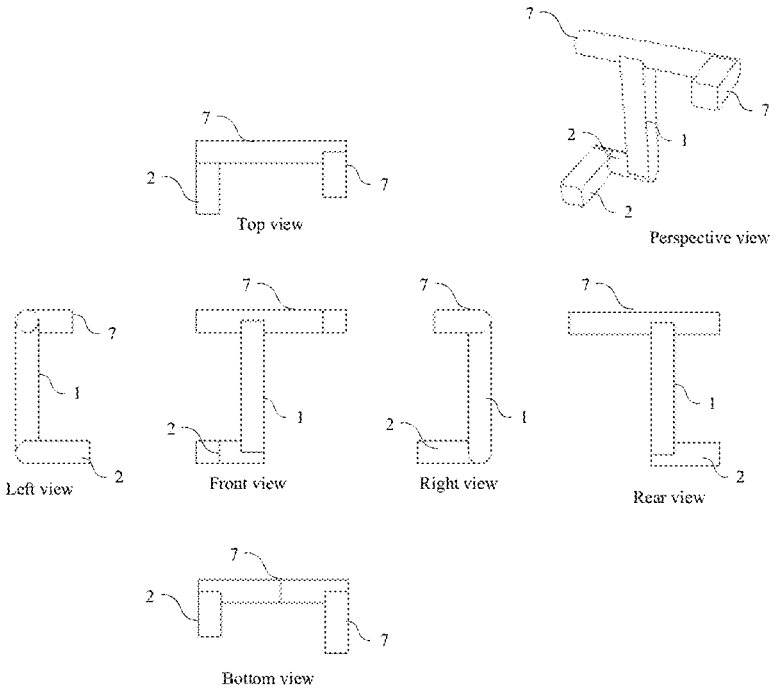
FIG. 5 is different views of a driving rod of the adsorptive anti-tipping device.
Figure 6A:
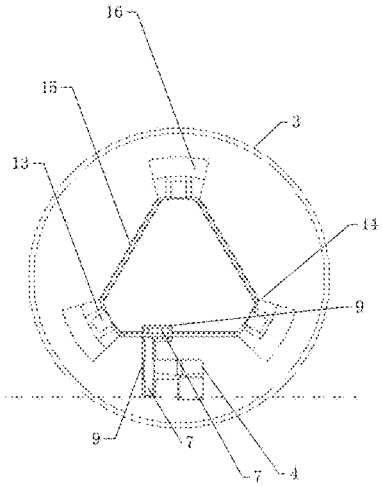
FIG. 6A is a top plan view of the adsorptive anti-tipping device.
Figure 6B:
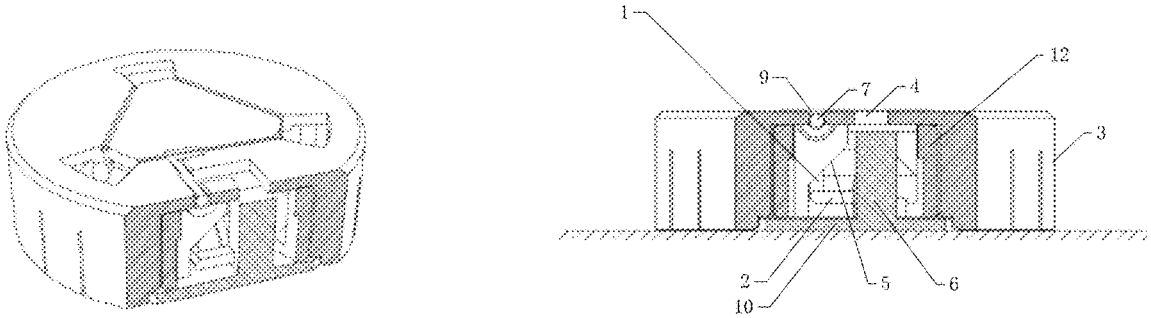
FIG. 6B comprises two cross-sectional views taken along the dash line in FIG. 6A, showing the adsorptive anti-tipping device being fixed to a surface.
Figure 6C:
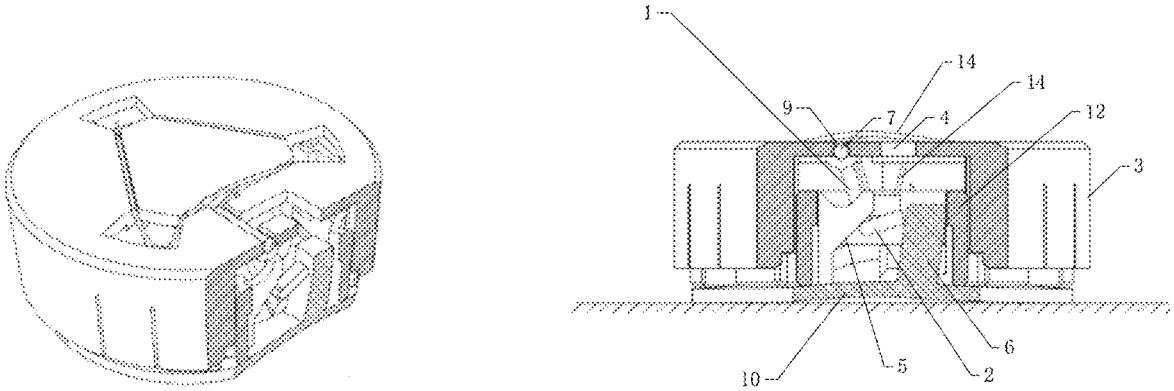
FIG. 6C comprises two cross-sectional views taken along the dash line in FIG. 6A, showing the adsorptive anti-tipping device being lifted before leaving the surface.

Referring to FIGS. 1 to 7D of the present application, an adsorptive anti-tipping device according to the present application is used to fasten a cup body and prevent the cup body from tipping, characterized in that it comprises a driving rod, including a sliding rod 1, a limit rod 7 and an abutment rod 2, wherein the limit rod 7 is vertically fixed on the upper end of the sliding rod 1; and the abutment rod 2 is fixedly connected with one end of the sliding rod 1, as shown in FIG. 5;

a fixed cover 3, wherein on the fixed cover 3 is arranged a sliding positioning hole 4, the limit rod 7 is limited above the fixed cover 3; the abutment rod 2 and sliding rod 1 pass through the sliding positioning hole 4 in turn, and the sliding rod 1 is vertically slidably positioned in the sliding positioning hole, as shown in FIGS. 6A-4D, and the upper end face of the fixed cover 3 can be disassembled and reassembled with the bottom end face of the cup body;

a suction component, wherein the suction component is slidably clamped with the fixed cover 3, and has a driving slope 5 and a driving block 6 on it, the driving block 6 corresponds to the position of the adsorptive surface of the suction component, the abutment rod 2 abuts with the driving block 6; and one side of the abutment rod 2 abuts against the driving slope 5, the sliding rod 1 drives the abutment rod 2 when sliding upward, and drives the driving block 6 to move under the action of the driving slope 5, as shown in FIG. 6C.

In other embodiments, the suction component comprises, arranged from top to bottom, a suction cup fixing seat 12, a suction cup 10 and a suction cup base 11, the driving block 6 is fixed at a position on the upper end face of the suction cup 10, close to the periphery of the suction cup; driving slope 5 is arranged on the inner surface of the suction cup fixing seat 12; the suction cup fixing seat 12, the suction cup 10 and the suction cup base 11 are fixed coaxially, as shown in FIG. 3; the peripheral side of suction cup fixing seat 12 is slidably clamped with the inner wall of the fixed cover 3.

In other specific embodiments, the side wall of the suction cup fixing seat 12 is annular, and outside the annular side wall are arranged sliding grooves 8 along the axial direction of the suction cup fixing seat 12, at least the upper end of each grooves is unobstructed; the inner wall of fixed cover 3 has corresponding sliding blocks, which sliding blocks are slidably connected in sliding grooves 8, as shown in FIG. 3.

Specifically, the suction cup fixing seat 12, the suction cup 10 and the suction cup base 11 are fixed by a bolt passing through successively.

Figure 6D:
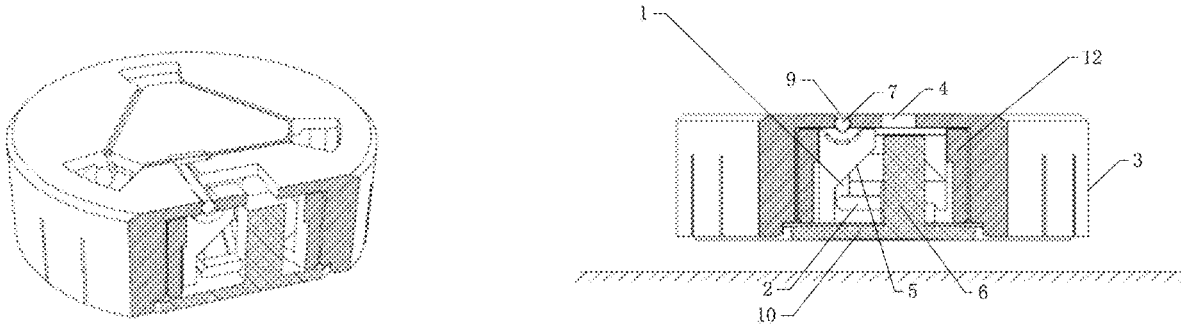
FIG. 6D comprises two cross-sectional views taken along the dash line in FIG. 6A, showing the adsorptive anti-tipping device being picked up and left the surface.
Figure 7A:
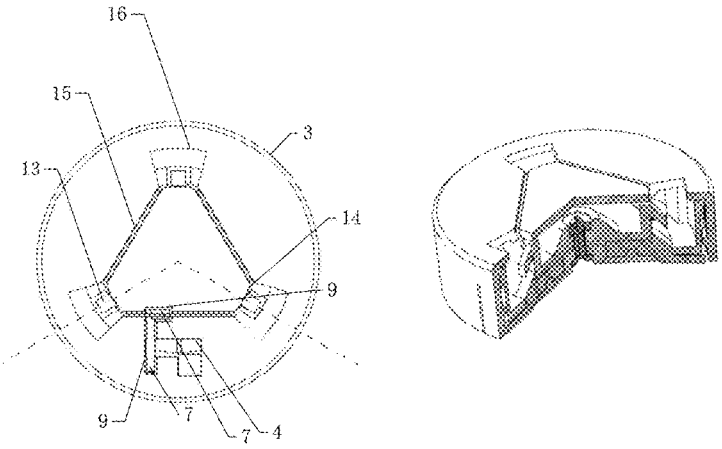
FIG. 7A shows a top plan view of the adsorptive anti-tipping device, and a perspective view taken along the dash lines in the top plan view.
Figure 7B:
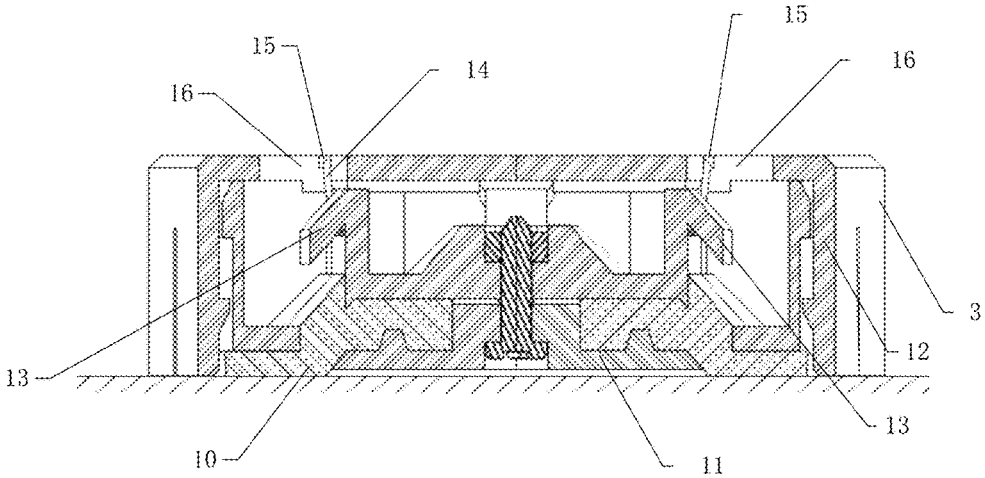
FIG. 7B comprises two cross-sectional views taken along the dash lines in FIG. 7A, showing the adsorptive anti-tipping device being fixed to a surface.
Figure 7C:
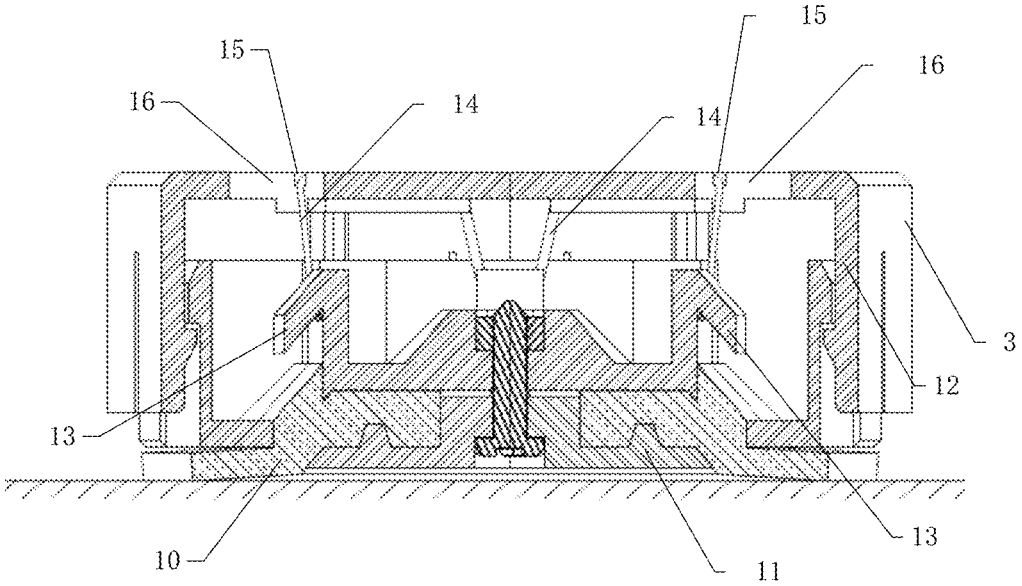
FIG. 7C comprises two cross-sectional views taken along the dash lines in FIG. 7A, showing the adsorptive anti-tipping device being lifted before leaving the surface.
Figure 7D:
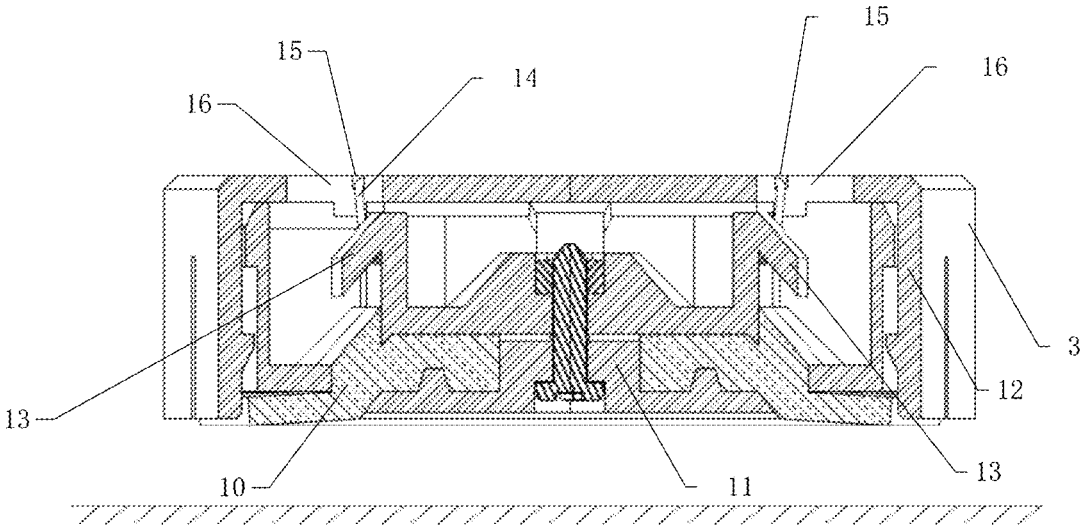
FIG. 7D comprises two cross-sectional views taken along the dash lines in FIG. 7A, showing the adsorptive anti-tipping device being picked up and left the surface.

In some other specific embodiments, the abutment rod 2 is L-type and horizontally arranged, as shown in FIG. 5, and the driving block 6 is provided with a step surface on the side facing abutment rod 2, the abutment rod 2 abuts with the step surface and the corresponding step side wall surface; the lower end of the sliding rod 1 is vertically fixed with one end of the abutment rod 2; on the fixed cover 3 is provided with an L-type through-hole for the abutment rod 2 to pass through, as shown in FIGS. 6B-6D.

Figure 1:
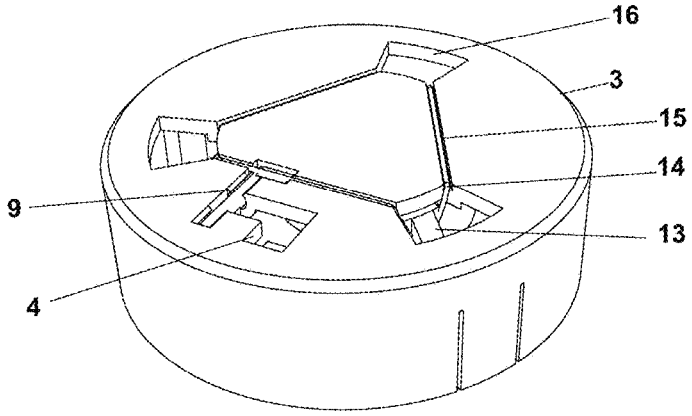
FIG. 1 is a top perspective view of an adsorptive anti-tipping device.
Figure 2:
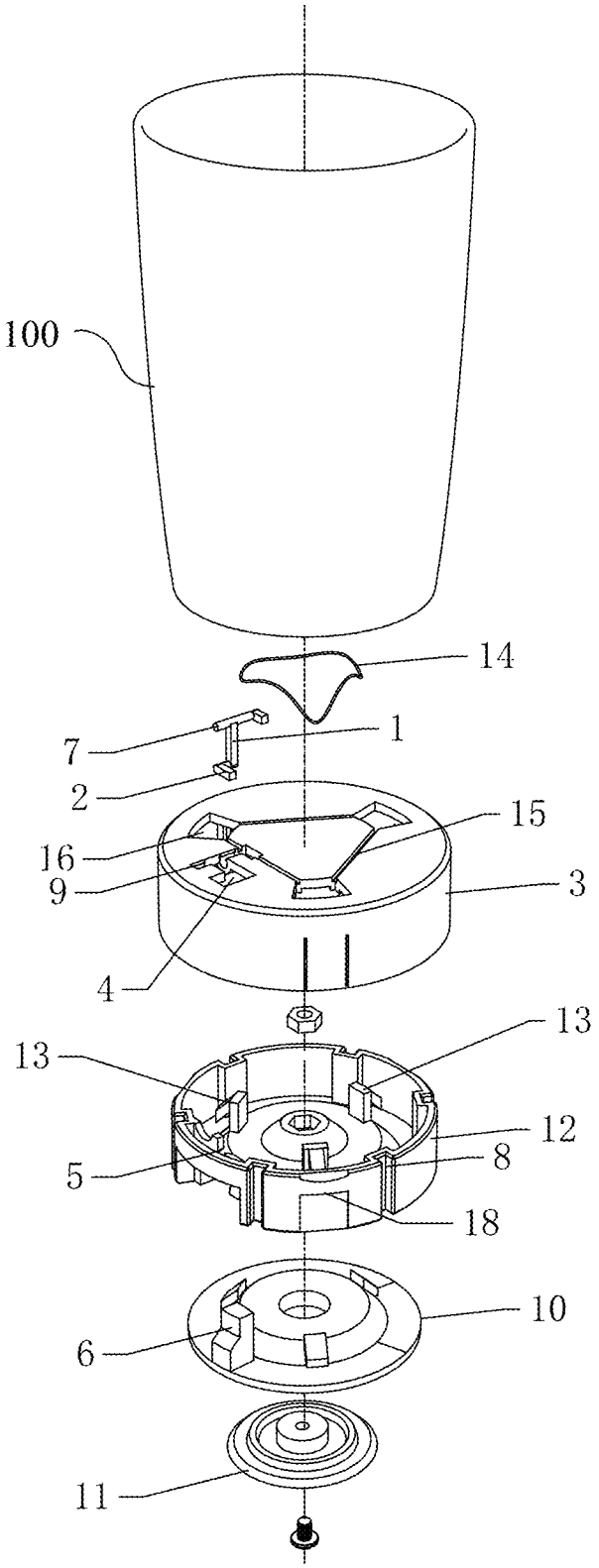
FIG. 2 is an exploded top perspective view of a cup comprising the adsorptive anti-tipping device of FIG. 1.

In some other embodiments, on the fixed cover 3 is arranged a limit groove 9, as shown in FIGS. 1-3, the limit rod 7 is fitly abutted in the limit groove, as shown in FIGS. 6A-6D.

Specifically, facing the inner circumference of the side wall of the suction cup fixing seat 12 are arranged a plurality of clamping blocks 13. Clamping blocks 13 are connected with a spring tightening rope 14, one end of the spring tightening rope 14 is passing through the fixed cover 3, going around the top of the fixed cover, and then connecting the adjacent clamping blocks 13 successively, thus the fixed cover 3 and the suction cup fixing seat 12 are closely fitted, facilitating the cup body's reset after it drives fixed cover 3 to move upward, as shown in FIGS. 7A-7D.

More specifically, on fixed cover 3 are arranged strip-shaped grooves 15, being located on the line that the spring tightening rope 14 above the fixed cover is fitly connected with the clamping blocks 13.

In some other embodiments, on the fixed cover 3 are also arranged installation grooves 16, and at the bottom end of the cup body 100 are integrally arranged a plurality of barbs 101 for fitting the installation grooves 16, as shown in FIG. 3, the barbs 101 are clamped in the installation grooves 16, as shown in FIGS. 4B-4C.

In addition, As shown in FIGS. 2-4C, the present application also discloses a cup body 100. The adsorptive anti-tipping device is used to fix the cup body 100 and prevent the cup body 100 from tipping. The cup body 100 is fixed on the fixed cover 3, and the suction component adsorbs nonporous surfaces, so as to realize that the cup body 100 is secured to the surface to prevent tipping and spillage of liquid.

Specific Process for Implementation

When the cup body is placed on the adsorptive anti-tipping device, press downward to make the barbs on the cup body buckle with the installation grooves at the upper end of the device. During the pressing process, the suction cup is adsorbed on the nonporous surface under the pressure. At this moment, attributing to the adsorption of the suction cup, the cup body or the container would not tip whether being pushed sideways from any direction. When one drinks water or picks up the cup, attributing to the barbs, the fixed cover moves up with the cup body, driving the sliding rod to move upward. At the same time, since the sliding rod abuts against the driving slope, the sliding rod also moves laterally during its upward movement, driving the driving block to move aside. At this time, tiny gap is generated between the driving block and the adsorption surface and then air enters, realizing the loosening of the suction cup, at this time the device is connected with the cup body. It is optionally that, after the cup body is picked up, the cup body is peeled from the device for the convenience of drinking or using, which also facilitates placing the cup body to the fixed cover of the device smoothly next time.

In respect of the device and the method of application as disclosed by the embodiments, the description is relatively simple because they correspond to the methods as disclosed in the embodiments. For the relevant points, please refer to the description of the method section.

The above description of the disclosed embodiment enables person skilled in the art to realize or utilize the present application. Various modifications to these embodiments will be obvious to those skilled in the art. The general principles defined herein can be implemented in other embodiments without departing from the spirit or scope of the present application. Therefore, the present application will not be limited to the embodiments shown herein, but will conform to the widest range consistent with the principles and novel features disclosed herein.

The invention claimed is:

1. An adsorptive anti-tipping device which is used to fasten a cup body and prevent the cup body from tipping, comprising:

a driving rod, including a sliding rod, a limit rod and an abutment rod, wherein the limit rod is vertically fixed on the upper end of the sliding rod; the abutment rod is fixedly connected with one end of the sliding rod;

a fixed cover, wherein on the fixed cover is arranged a sliding positioning hole, the limit rod is limited above the fixed cover; the abutment rod and sliding rod pass through the sliding positioning hole in turn, and the sliding rod is vertically slidably positioned in the sliding positioning hole, and the upper end face of the fixed cover can be disassembled and reassembled with the bottom end face of the cup body;

a suction component, wherein the suction component is slidably clamped with the fixed cover, and has a driving slope and a driving block on it, the driving block corresponds to the position of the adsorptive surface of the suction component, the abutment rod abuts with the driving block; and one side of the abutment rod abuts against the driving slope, the sliding rod drives the abutment rod when sliding upward, and drives the driving block to move under the action of the driving slope; and wherein the suction component comprises, arranged from top to bottom, a suction cup fixing seat, a suction cup and a suction cup base, the driving block is fixed at a position on the upper end face of the suction cup, close to the periphery of the suction cup; the driving slope is arranged on the inner surface of the suction cup fixing seat; the suction cup fixing seat, the suction cup and the suction cup base are fixed coaxially; the peripheral side of the suction cup fixing seat is slidably clamped with the inner wall of the fixed cover.

2. The adsorptive anti-tipping device according to claim 1, wherein the side wall of the suction cup fixing seat is annular, and outside the annular side wall are arranged sliding grooves 8 along the axial direction of the suction cup fixing seat, at least the upper end of each grooves is unobstructed; the inner wall of the fixed cover has corresponding sliding blocks, which sliding blocks are slidably connected in the sliding grooves.

3. The adsorptive anti-tipping device according to claim 1, wherein the suction cup fixing seat, the suction cup and the suction cup base are fixed by a bolt passing through successively.

4. The adsorptive anti-tipping device according to claim 1, wherein the abutment rod is L-type and horizontally arranged, and the driving block is provided with a step surface on the side facing the abutment rod, the abutment rod abuts with the step surface and the corresponding step side wall surface; the lower end of the sliding rod is vertically fixed with one end of the abutment rod; on the fixed cover is provided with an L-type through-hole for the abutment rod to pass through.

5. The adsorptive anti-tipping device according to claim 1, wherein on the fixed cover is arranged a limit groove, the limit rod is fitly abutted in the limit groove.

6. The adsorptive anti-tipping device according to claim 1, wherein, facing the inner circumference of the side wall of the suction cup fixing seat are arranged a plurality of clamping blocks, the clamping blocks are connected with a spring tightening rope, one end of the spring tightening rope is passing through the fixed cover, going around the top of the fixed cover, and then connecting the adjacent clamping blocks successively, thus the fixed cover and the suction cup fixing seat are closely fitted, facilitating the cup body's reset after it drives the fixed cover to move upward.

7. The adsorptive anti-tipping device according to claim 6, wherein, on the fixed cover are arranged strip-shaped grooves, being located on the line that the spring tightening rope above the fixed cover is fitly connected with the clamping blocks.

8. The adsorptive anti-tipping device according to claim 1, wherein, on the fixed cover are also arranged installation grooves, and at the bottom end of the cup body are integrally arranged a plurality of barbs for fitting the installation grooves, the barbs are clamped in the installation grooves.

9. A cup body comprising the adsorptive anti-tipping device according to claim 1 and a cup body, wherein the adsorptive anti-tipping device is used to fix the cup body and prevent the cup body from tipping, the cup body is fixed on the fixed cover (3), and the suction component adsorbs nonporous surfaces, so as to realize that the cup body is secured to the surface to prevent tipping and spillage of liquid.

* * * * *